US006065655A

United States Patent [19]

Parewick

[11] Patent Number: 6,065,655

[45] **Date of Patent: *May 23, 2000**

[54] COMBINATION BABY CARRIER AND SEAT HARNESS APPARATUS

[76] Inventor: Kathleen Parewick, 89 Bond St., St. Johns, Newfoundland, Canada, A1C 1T3

[ * ] Notice: Under 35 U.S.C. 154(b), the term of this patent shall be extended for 461 days.

[21] Appl. No.: 08/640,078

[22] Filed: Apr. 30, 1996

Related U.S. Application Data

[63] Continuation of application No. 08/217,290, Mar. 24, 1994, abandoned.

[51] Int. Cl.[7] ..... A61G 1/00; A47C 31/00

[52] U.S. Cl. ..... 224/158; 224/159; 297/467; 297/485; D3/214

[58] Field of Search ..... 224/158–161, 224/254, 257, 258, 264, 269, 907, 148.2; 297/467, 485; D3/213, 214

[56] References Cited

U.S. PATENT DOCUMENTS

| | | | |
|---|---|---|---|
| D. 176,433 | 12/1955 | Stringini . | |
| D. 332,865 | 2/1993 | Wilmink . | |
| 2,411,721 | 11/1946 | Hancock et al. . | |
| 2,652,183 | 9/1953 | Hivka | 297/485 |
| 3,027,058 | 3/1962 | Huber . | |
| 3,327,914 | 6/1967 | Abram . | |
| 4,139,130 | 2/1979 | Glusker et al. | 224/148.2 |
| 4,139,131 | 2/1979 | Hathaway . | |
| 4,166,558 | 9/1979 | Schroeder . | |
| 4,188,065 | 2/1980 | Meeker . | |
| 4,235,474 | 11/1980 | Rosenberg . | |
| 4,428,514 | 1/1984 | Elf . | |
| 4,544,088 | 10/1985 | Reding . | |
| 4,717,056 | 1/1988 | Carmichael . | |
| 4,724,988 | 2/1988 | Tucker | 224/160 |
| 4,757,925 | 7/1988 | Knittel . | |
| 4,871,210 | 10/1989 | Alexander et al. . | |
| 5,011,057 | 4/1991 | Perruzza et al. . | |
| 5,071,047 | 12/1991 | Cordisco . | |
| 5,205,451 | 4/1993 | Manzer . | |
| 5,297,852 | 3/1994 | Morales-Quintero | 297/485 |

FOREIGN PATENT DOCUMENTS

| | | |
|---|---|---|
| 663786 | 5/1963 | Canada . |
| 860 155 | 1/1971 | Canada . |
| 988 475 | 5/1973 | Canada . |
| 1 167 426 | 5/1984 | Canada . |
| 2 078 015 | 3/1993 | Canada . |
| 2 662 339-A1 | 11/1991 | France . |
| 144 648 | 10/1980 | Germany . |
| 649206 | 5/1985 | Switzerland . |
| 1 560 260 | 1/1980 | United Kingdom . |
| 2 253 988 | 9/1992 | United Kingdom . |

*Primary Examiner*—Gregory M. Vidovich
*Attorney, Agent, or Firm*—Swabey Ogilvy Renault

[57] ABSTRACT

A sling-type combination child carrying and seat harness apparatus comprises a piece of suitable fabric having at opposite first and second ends thereof a pair of rings and a pair of elongated ties, the latter being adapted to be threaded through the rings and secured thereto to form a loop which is required in a child carrying position of the apparatus. The fabric defines a pouch between the first and second ends for receiving the child in the child carrying position of the apparatus which has been suspended from an adult's shoulder. The apparatus comprises a pocket defined at the first end adjacent the rings in order that the apparatus may be used as a seat harness for a chair or the like having a seat and a back rest. In this case, the apparatus and, more particularly, the pouch is laid partly on the seat of the chair and the pocket is slidably engaged over the back rest. The child is then seated and the fabric intermediate the child and the ties is twisted and brought up diaper-like between the child's legs. The ties are pulled apart and the fabric slack is rolled up, sausage-style, until gathered closely against the front of the child's body. The ties are then brought around the sides of the child and of the back rest of the chair before being secured to the rings behind the back rest.

16 Claims, 9 Drawing Sheets

COMBINATION BABY CARRIER AND SEAT HARNESS APPARATUS

This application is a continuation of application Ser. No. 08/217,290, filed on Mar. 24, 1994, now abandoned.

BACKGROUND OF THE INVENTION

1. Field of the Invention

The present invention relates to baby carriers and, more particularly, to a baby carrier which can assume various infant carrying positions and which doubles as a seat harness for securing the infant to different types of chairs not provided with appropriate and safe infant attachment harnesses.

2. Description of the Prior Art

Throughout the years, various infant carriers have been proposed for carrying an infant on an adult's back or in front thereof or for carrying the infant like in a basket suspended from an adult's hands, and for attaching a child to a standard "adult" chair and also in a shopping cart, or the like.

For instance, French Patent Publication No. 2,662,339 published on Nov. 21, 1991 in the name of Schlegel and Canadian Patent No. 860,155 issued to Aukerman on Jan. 5, 1971 each teach a baby carrier with two elongated shoulder straps that can be inserted into a pair of buckles for carrying a child on a person's back.

U.S. Pat. No. 4,544,088 issued on Oct. 1, 1985 to Reding discloses a child carrier and sling consisting of two straps with two loops to form a cradle to support the child in a sitting position around the adult's waist, as seen in FIG. 3 of the Patent.

British Patent Publication No. 1,560,260 published on Jan. 30, 1980 in the name of Mothercare Limited discloses a baby carrying sling worn around an adult's shoulder for receiving the child in a sitting position.

East German Patent Document No. DD-144,648 published on Oct. 29 ,1980 in the name of Teschner et al. discloses a vehicle safety harness for infants which consists of a flexible basket-like container to be positioned on an adult's lap and a shoulder strap for the adult as well as a cover for the child.

U.S. Design Pat. No. 332,865 issued on Feb. 2, 1993 to Wilmink and U.S. Pat. No. 4,717,056 issued on Jan. 5, 1988 to Carmichael both disclose an infant carrying bag.

Canadian Patent No. 988,475 issued on May 4, 1976 to Gerico, Inc., U.S. Design Pat. No. 176,433 issued on Dec. 20, 1955 to Stringini, U.S. Pat. No. 2,411,721 issued on Nov. 26, 1946 to Hancock et al. and U.S. Pat. No. 3,327,914 issued on Jun. 27, 1967 to Abram all disclose various infant carriers including shoulder straps and a basket suspended therefrom for receiving a child in a sitting position.

U.S. Pat. No. 5,011,057 issued on Apr. 30, 1991 to Peruzza et al., U.S. Pat. No. 4,166,558 issued on Sep. 4, 1979 to Schroeder and U.S. Pat. No. 4,757,925 issued on Jul. 19, 1988 to Knittel all disclose various infant carriers including shoulder straps and a basket suspended therefrom for receiving a child in a resting, breast-feeding or sleeping position.

British Patent Publication No. 2,253,988 published on Sep. 30, 1992 in the name of Smith and U.S. Pat. No. 5,071,047 issued on Dec. 10, 1991 to Cordisco each disclose a baby carrier comprising a shoulder strap and a receptacle suspended therefrom adapted to carry the infant in various positions, such as sitting and sleeping positions in front of the adult and a sitting position on the adult's back.

Canadian Patent No. 1,167,426 issued on May 15, 1984 to Gougeon and Canadian Patent Application No. 2,078,015 laid-open on Mar. 17, 1993 in the name of Hooi disclose respectively a chair suspended from an adult's shoulder for carrying handicapped children and a spring suspended hammock type infant cradle.

SUMMARY OF THE INVENTION

It is therefore an aim of the present invention to provide an improved infant carrying apparatus which can be worn differently so as to carry the baby or child in various positions, e.g. sitting or lying positions.

It is also an aim of the present invention to provide an infant carrying apparatus which doubles as a harness for securing a baby or child in a sitting position on various types of chairs having backrests and in a shopping cart.

Therefore, in accordance with the present invention, there is provided a sling-type child carrying apparatus comprising a pouch means adapted to receive a child in sitting or sleeping positions, cooperating attachment means provided at opposite first and second ends of the apparatus in order that the apparatus defines a loop including shoulder strap means when the first and second ends are attached one to another by way of the attachment means, the pouch means being located intermediate the first and second ends, the apparatus being adapted for use as a seat harness for a chair or the like having seat and back parts, wherein the apparatus is laid partly on the seat part of the chair, the child being seated substantially on the pouch means with the apparatus being secured to the back part of the chair substantially at the first end thereof, the apparatus intermediate the child and the second end being brought up between the child's legs with the second end being brought around at least one side of the child and being secured behind the child to the chair or to the first end by way of the attachment means.

The apparatus can be provided adjacent the first end with engagement means adapted to be engaged on the back part of the chair in a seat harness position of the apparatus with the attachment means of the first end being positioned behind the chair in the seat harness position.

The attachment means may comprise catch means and tie means provided respectively at the first and second ends and adapted to be detachably secured to one another to form the loop used in a child carrying position of the apparatus, the tie means forming the shoulder strap means in the child carrying position.

Preferably, the engagement means comprise a hood means provided between the first end and the pouch means, the hood means being opened at an inner end thereof located adjacent to the pouch means in order that the hood means can be slid over the back part of the chair in the seat harness position.

The hood means may comprise a pair of side openings defined between the first end and an inner transversal end of the hood means located adjacent the pouch means, the openings allowing upper corners of the back part of the chair to extend through the hood means.

Preferably, the inner end of the hood means comprises elastic means for allowing the hood means to be slid over the back part of the chair and to be then relatively tightly secured to the chair.

Also, the hood means can embody padding means for providing the apparatus with a pillow-like support for the child's head when the child is in the sleeping position with the apparatus being in the child carrying position.

The tie means may comprise a pair of spaced apart elongated straps, the catch means comprising a pair of rings attached at the first end, the straps being engageable in the rings for securing the first and second together.

Furthermore, the apparatus asides from the rings is substantially all made of flexible fabric, the hood means being formed by a transversal fold of the fabric at the first end inwardly towards and above the pouch means, with the fabric having been threaded through the rings at the first end, inner corners of a folded over portion of the fabric being attached adjacent the pouch means thereby forming the hood means which is open-ended inwardly towards the pouch means and which defines the side openings.

Cushioned members are normally provided at longitudinal sides of the apparatus at least opposite the pouch means.

The present apparatus is patterned after humankind's most enduring and widespread child carrying technique. All over the world, people wrap lengths of fabric, such as carves, saris, sarongs, about themselves to secure infants and young children.

The combination baby carrier and seat harness apparatus of the present invention can thus be used to carry a baby or a child in a variety of positions, depending both on the size and stage of physical development of the child and on the activity the person wearing the carrier is engaged in. The most common position used is the "hip-straddle" position, wherein the child seats in the sling with legs spread-eagled around the parent's waist so that the child's weight rests comfortably on the parent's hip in a manner naturally used with children from the time they can sit up. The other popular position is the "cradle-carry", wherein the child is positioned more or less lying down in the sling, curled tummy-to-tummy with the wearer. This is the position used for infants which are still unable to sit and for napping children as well as for breast-feeding.

There are variations of each of the above positions, such as the "piggyback" and the "kangaroo carry", where the child in a hip-straddle position is shifted from the adult's aside to, respectively, the front or the back of the adult. Some infants enjoy the view they have with another version of the kangaroo carry where they sit up facing out in the sling, their back on the adult's chest. The cradle carry position can be rotated under the arm for a "football hold". The child may also be strapped with the sling to the wearer's chest or across the shoulder.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figure 1:
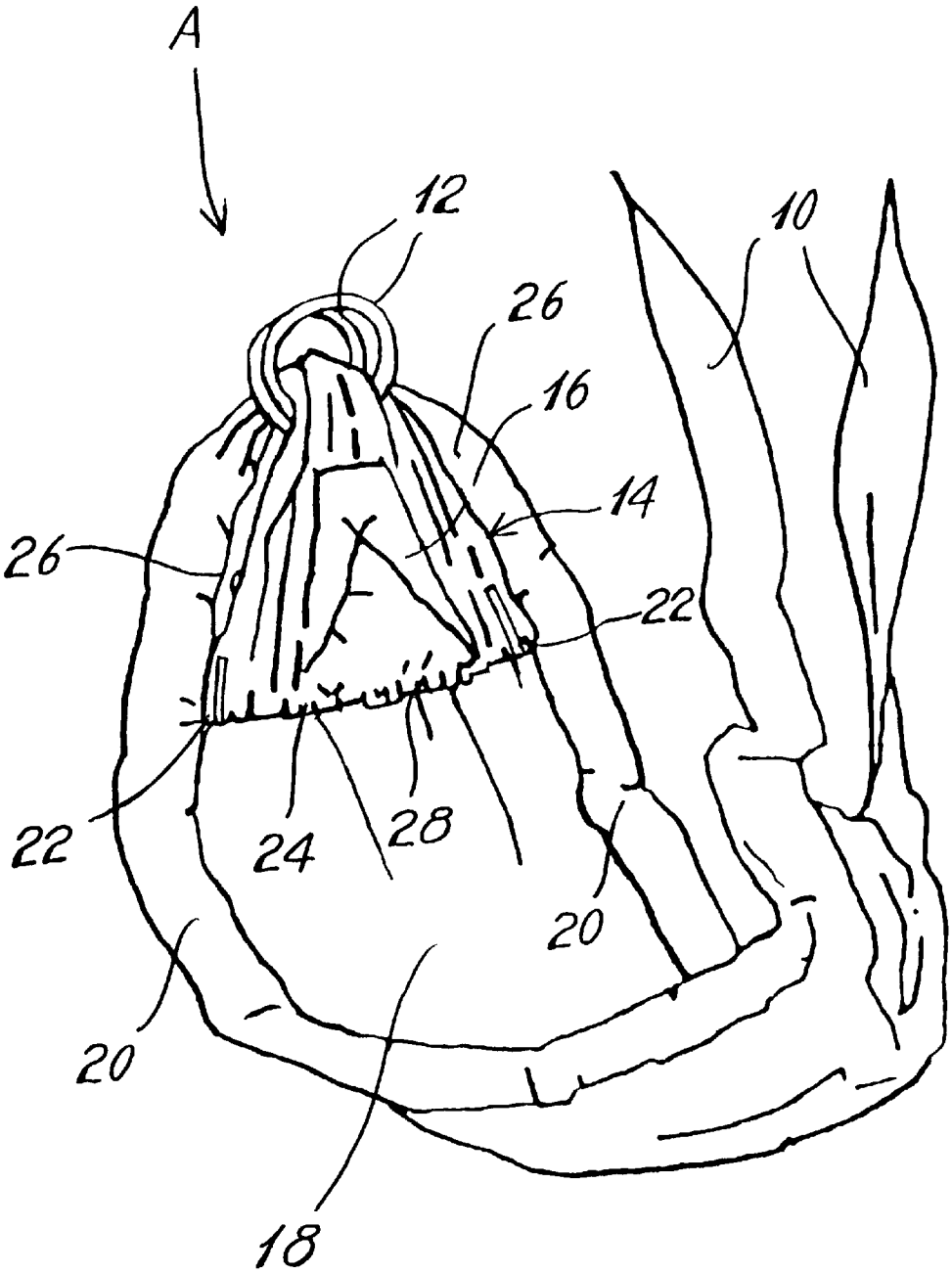
FIG. 1 is a perspective view of a combination infant carrier and seat harness apparatus in accordance with the present invention, the apparatus being shown in an infant carrying position thereof.

In accordance with the present invention, FIG. 1 illustrates a combination infant carrier and seat harness apparatus A which can be worn in infant carrying or seat harness positions. In the infant carrying position, the apparatus A is worn as a sling suspended from an adult's shoulder, either in a hip-straddle position (see FIG. 4*b*) or a cradle-carry position (see FIG. 5*b*), whereas in the seat harness position, the apparatus A is used to secure a child or baby in a sitting position on various types of chairs when highchairs are not available, such as on a standard "adult" chair (see FIG. 6*c*) and in a shopping cart (see FIG. 7). Therefore, the apparatus is basically an adjustable shoulder supported sling which suspends therefrom for receiving the baby or child therein and which doubles as a seat harness. The apparatus A which optionally can include pockets is designed so that it is unlikely to induce back strain to the parent or adult carrying it.

Basically, the apparatus A is made of fabric and includes two longitudinally oriented elongated ties or straps 10 extending at one end thereof and, at the other end thereof, a pair of rings 12, a harness hood 14 and a pillow 16 provided in the harness hood 14. The apparatus A defines between the straps 10 and the harness hood 14 a child receiving pouch 18 with protective side bumpers 20 being provided on each side of the pouch 18 right up to the rings 12. The harness hood 14 is attached at the lower side corners 22 thereof to the bumpers 20 with an elastic being integrated in the lower edge of the harness hood 14 to form an elasticized portion 24, whereby side openings are defined at 26 between the harness hood 14 and the bumpers 20 with a lower opening being defined at 28 between the lower edge and the elasticized portion 24 of the harness hood 14 and the fabric of the pouch 18. This configuration, as it will be explained in more details hereinafter, is used for inserting the harness hood 14 over the back rest of a chair in the aforementioned seat harness position of the present apparatus A.

Figure 2A:
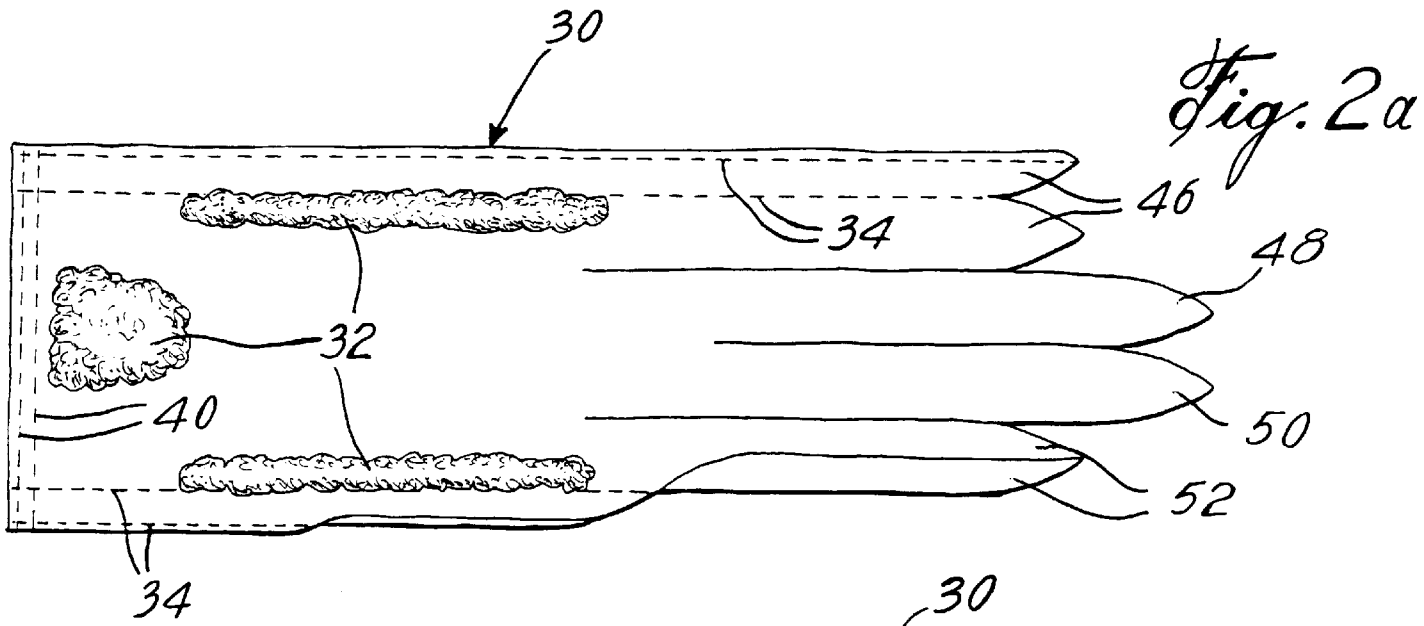
FIGS. 2*a* to 2*d* are a series of schematic plan views showing steps of a method for producing the combination infant carrier and seat harness apparatus of FIG. 1.
Figure 2B:
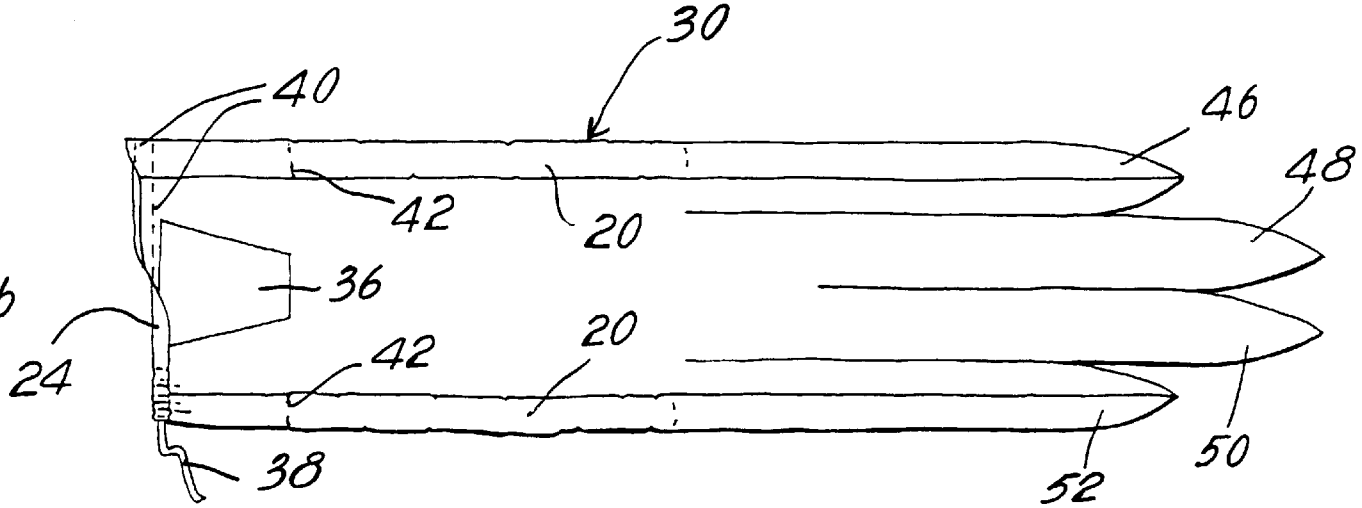

Referring to FIGS. 2*a* to 2*d,* the apparatus A is constructed, for instance, by using a piece of fabric 30 made of shirt-weight 100% cotton which is initially cut generally as per the outline illustrated in FIG. 2*a* except for the lower right section of the fabric 30 of FIG. 2*a* which has been partly folded over for illustration purposes. Paddings 32 are positioned at locations which will produce the pillow 16 of the harness hood 14 and the bumpers 20 once the assembly of the apparatus A has been completed. The dotted lines in FIGS. 2*a* to 2*d* represent fold lines. The long sides are folded over along dotted lines 34 of FIG. 2*a* to enclose the paddings 32 for the bumpers 20. Referring to FIGS. 2*a* and 2*b*, a piece of fabric 36 is sewn over the padding 32 corresponding to the pillow 16. An elastic member 38 is positioned transversely at the square end of the fabric 30 and the fabric is folded at dotted lines 40 to enclose the elastic member 38.

Figure 2C:
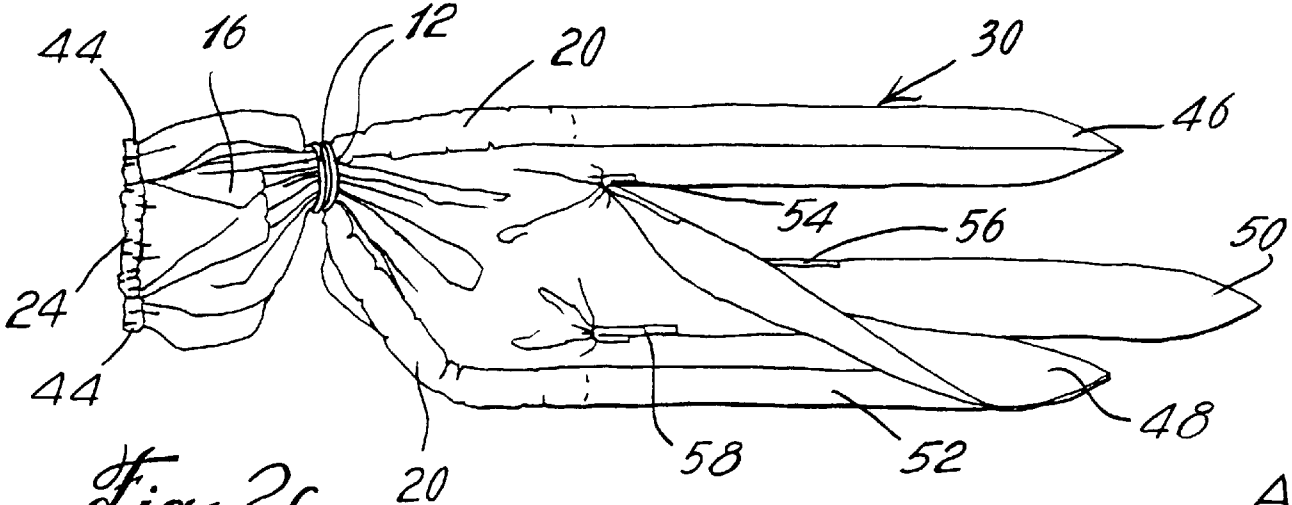
Figure 2D:
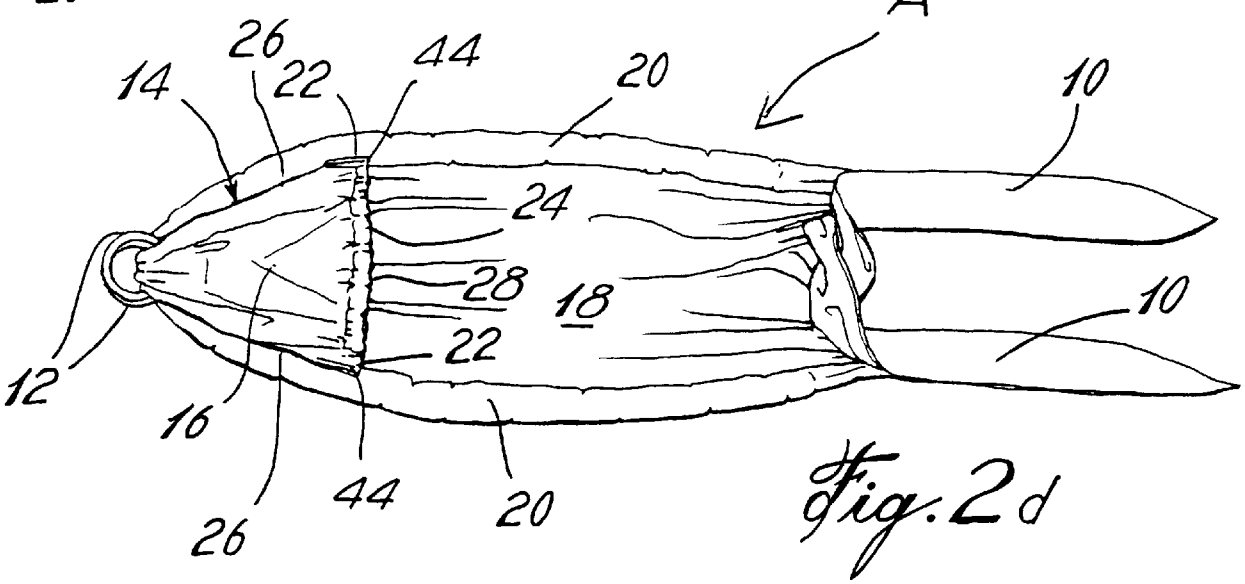

With reference to FIG. 2*c*, the square end of the fabric 30 is threaded through the aforementioned two wooden or plastic rings 12. The square end of the fabric 30 with the elasticized portion 24 thereof is folded over at dotted lines 42 of FIG. 2*b* towards the inside of the fabric 30 and the ends 44 of this elasticized portion 24 are sewn to the fabric 30 and, more particularly, to respective bumpers 20, as seen in FIG. 2*d*. In FIG. 2*b*, the scalloped end of the fabric 30 defines four (4) strips 46, 48, 50 and 52. The raw edges of the strips 46, 48, 50 and 52 are reinforced at their respective adjoining deepest parts 54, 56 and 58 of the cutstand. Referring to FIG. 2*c*, the strips 46, 48, 50 and 52 are sewn together two-by-two while matching their respective ends. More particularly, strip 46 is sewn to strip 50 (see FIG. 2*c*) and strip 48 is sewn to strip 52, the end result being shown in FIG. 2*d* which illustrate the aforementioned two straps 10. The strips are topstitched shut.

Figure 3A:
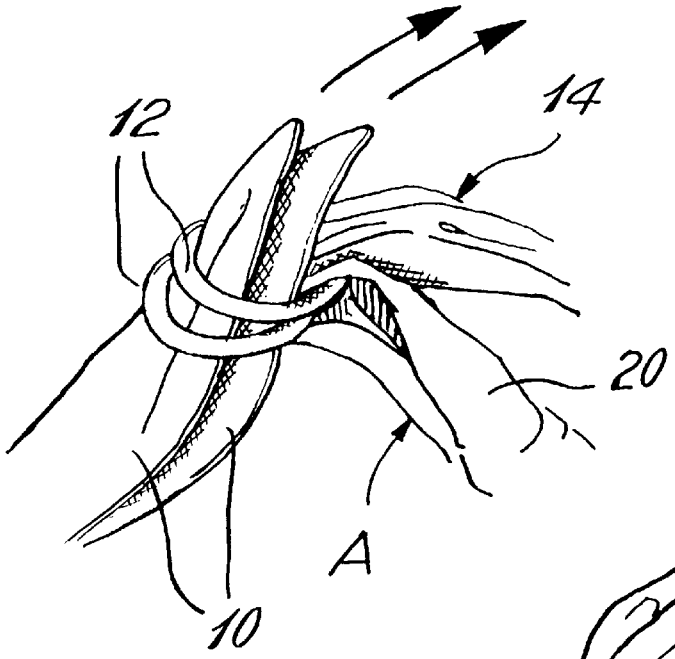
FIGS. 3*a* and 3*b* are perspective schematic views of part of the apparatus which show two steps for attaching the straps of the apparatus for assembling the same in its baby carrying position.
Figure 3B:
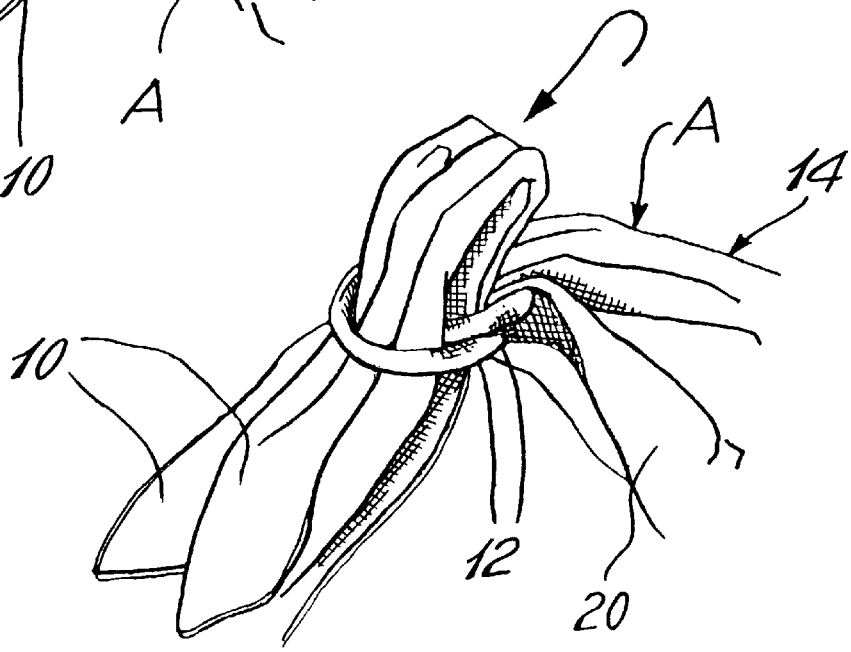
Figure 4A:
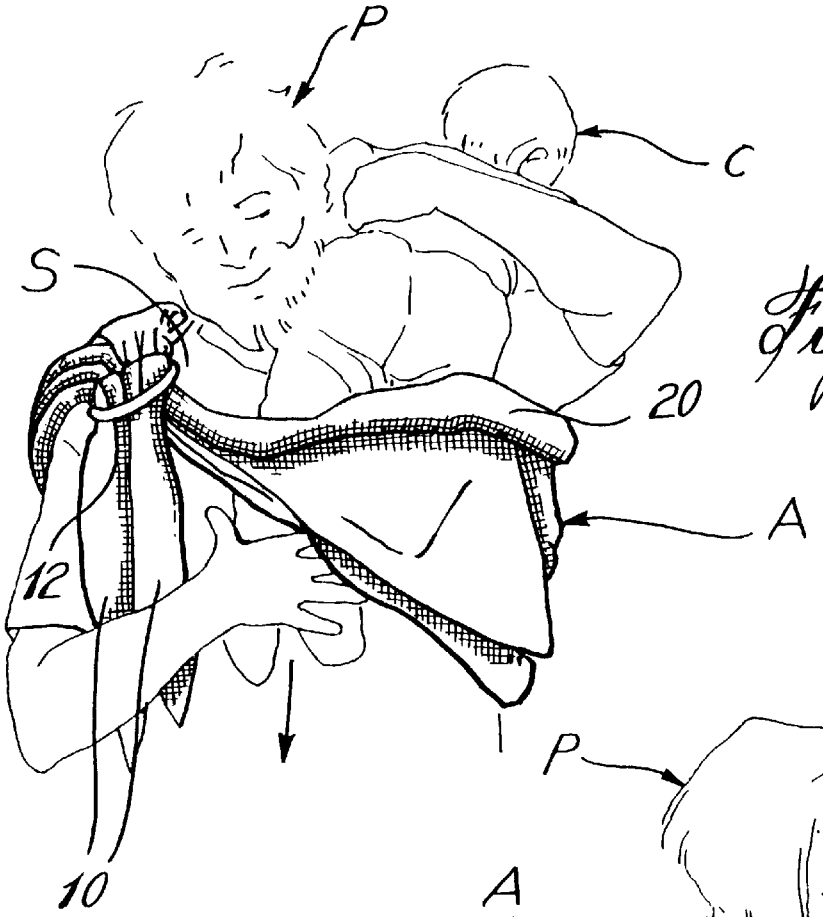
FIGS. 4*a* and 4*b* are schematical views showing subsequent steps for positioning a child in the apparatus of the present invention in the baby carrier position thereof shown in FIG. 1 with the child being carried therein in a hip-straddle position.
Figure 4B:
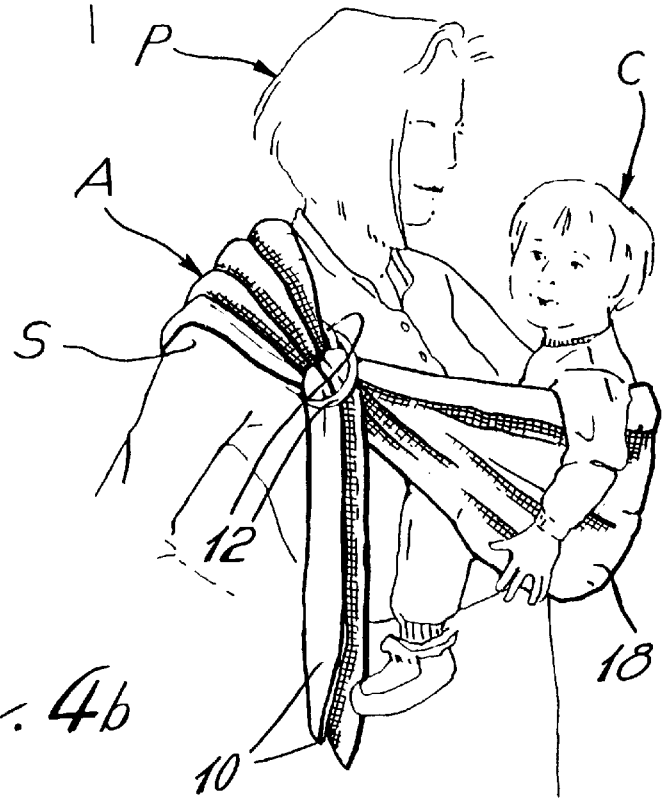
Figure 5B:
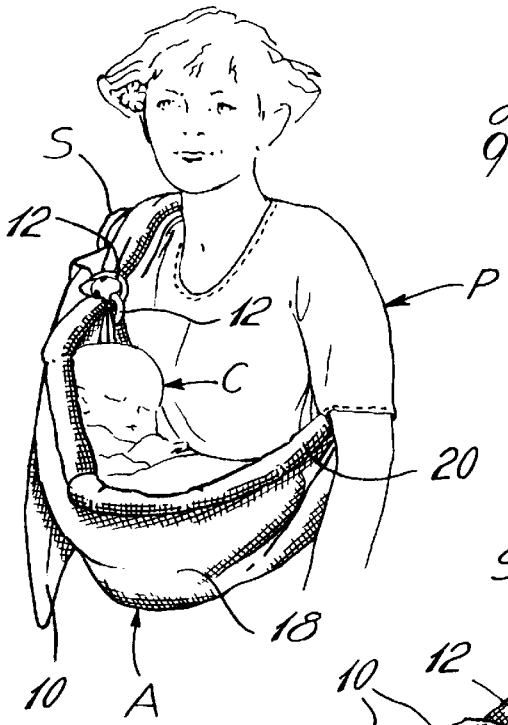
FIGS. 5*a* and 5*b* are schematical views showing subsequent steps for positioning a child in the apparatus of the present invention in the baby carrier position thereof shown in FIG. 1 with the child being carried therein in a cradle-carry position.
Figure 5A:
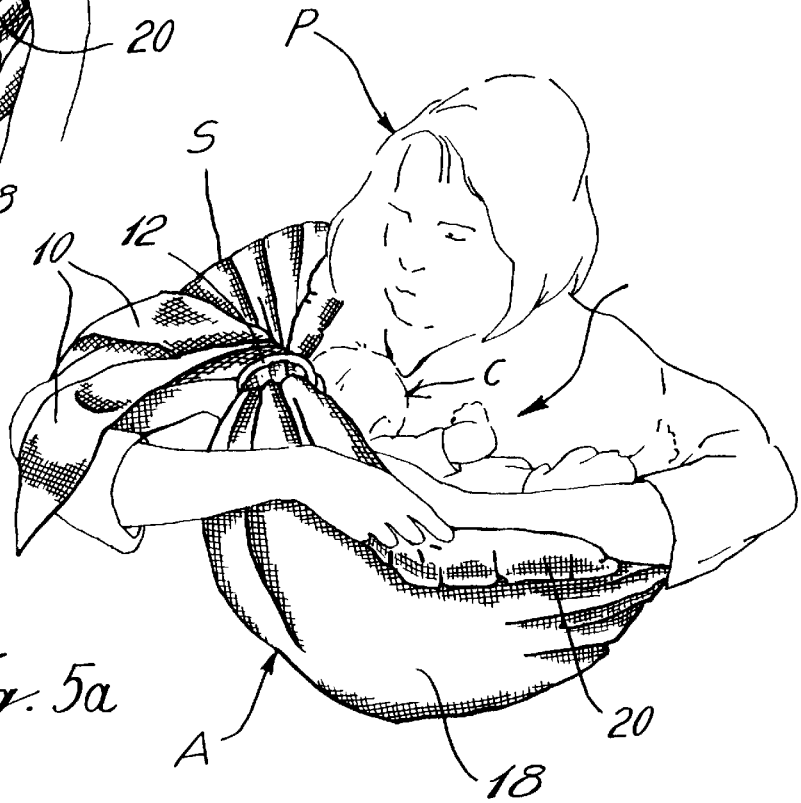

Now referring to FIGS. 3*a* and 3*b*, in the infant carrying position of FIGS. 4*a*, 4*b*, 5*a* and 5*b*, the elongated straps 10 are threaded through the rings 12 (FIG. 3*a*) and then inserted between the two rings 12 (FIG. 3*b*) in a well-known fashion in order that the apparatus A forms a loop, as seen in FIG. 1. The apparatus A defining this loop can thus be supported by a shoulder S of an adult/parent P, as seen if FIGS. 4*a*, 4*b*, 5*a* and 5*b*, with a baby or child C being carried in the enlarged pouch 18. The baby/child C can be positioned in the pouch 18 in a sitting, i.e. hip-straddle, position (FIG. 4*b*) or in a cradle position (FIG. 5*b*), with FIGS. 4*a* and 5*a* showing how the child C is inserted in the pouch 18 of the apparatus A before settling into the sitting and cradle positions represented in FIGS. 4*b* and 5*b*, respectively. As a variant to the hip-straddle position, the apparatus A can also be positioned so as to carry the child on the adult's back.

Accordingly, for using the present apparatus A in the hip-straddle position thereof, one must first loosen the sling and the adult must choose the shoulder from which it will hang, that is the shoulder opposite to the hip which the child will straddle. For illustration purposes, we will now assume that the sling will hang from the right shoulder and the child will straddle the left hip as in FIGS. 4*a* and 4*b*. It is noted that, in the hip-straddle position, the sling is usually worn with a pillow on the adult's shoulder, especially when carrying toddlers. The sling or apparatus A is held out in front of the wearer using the wearer's right arm. The wearer must put his left arm through the loop of the sling and with his right arm he must pull the sling over his head until it is draped diagonally from the right shoulder and around under the left arm. The sling is positioned so that the rings are in front of the wearer, just below the wearer's right shoulder.

The child is in position in the pouch 18 of the apparatus A, as seen in FIG. 4*a*, with the child C resting high across the wearer's left shoulder, the child being held in place with the wearer's left hand. The wearer must then reach up through the sling with his right hand, grasp the child's legs, and using both arms lower the child into the loop of the sling along the direction of the arrow of FIG. 4*a*. While still supporting the child's weight, the wearer must adjust the sling so that the child is fully seated in the pouch 18 of the sling. Next, the wearer must check that the child's fingers and hair are clear of the rings 12. Then, the sling is tightened by pulling the ties 10. The child should now be supported by the sling or apparatus A and should snugly straddle the wearer's hip, as seen in FIG. 4*b*.

In the cradle-carry position of the apparatus A shown in FIG. 5*b*, the pad or pillow 16 of the sling is worn in front of the wearer so as to act as a pillow and back-support for the baby. The sling is oriented on the basis of which side the wearer wishes to have the infant's head, perhaps the side corresponding to the next breast-feeding in the cases where the wearer is the child's mother. The wearer must proceed as in the hip-straddle position described hereinabove, except that as the wearer brings the infant down from his shoulder, the wearer must support the baby's back and head while opening the sling into a hammock shape. The baby is slipped into the hammock, that is in the pouch 18, in such a way that the child's head rests comfortably on the pillow 16 and clear of the rings 12, as seen in FIG. 5*a*. The wearer must always check the position of the child's feet. The child will lie curled along the length of the sling A, a position many infants prefer, and will lie flatter if positioned more on a diagonal across the width of the sling.

Now referring to FIGS. 6*a*, 6*b*, 6*c* and 7, the combination baby carrier and seat harness apparatus A of the present invention is now used in the seat harness position thereof. Generally, previous seat harnesses have been most commonly designed to secure the child in a sitting position in regular high-backed chairs when a high chair is unavailable and/or in the standard seats of shopping carts. It is noted that the seat harness position of the apparatus A is intended to be used only for children which are able to sit up, unaided. In such cases, the present apparatus A makes a convenient seat harness whenever a high chair is not available and can also be used to secure the child in a standard shopping cart seat.

Figure 6A:
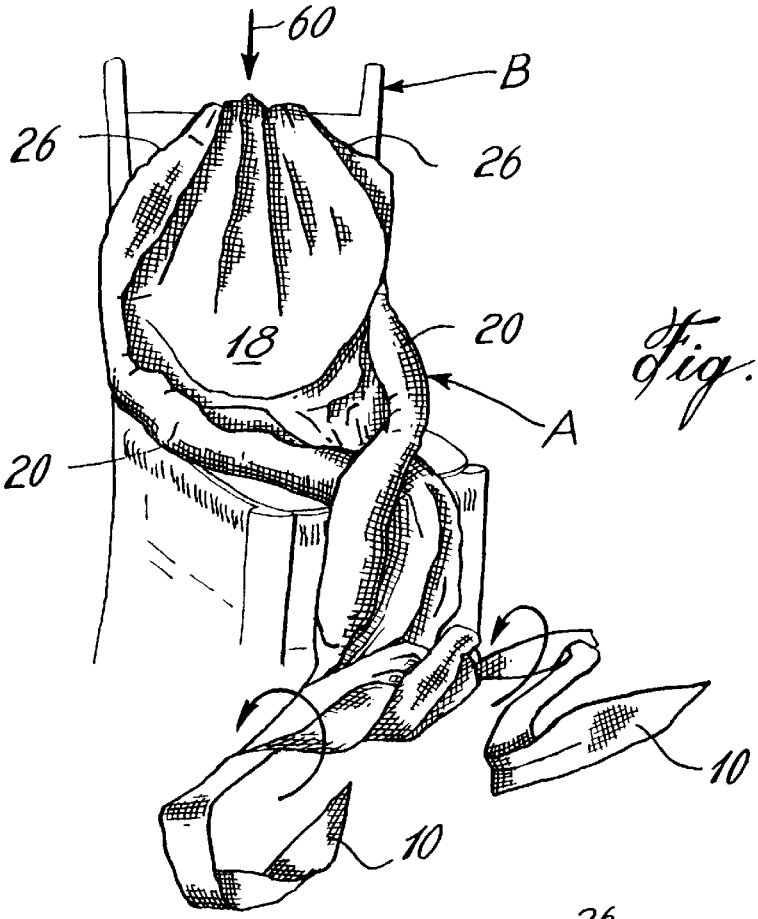
FIGS. 6*a* to 6*c* are schematical views showing subsequent steps for positioning a child in the apparatus of the present invention in a seat harness position thereof using the apparatus of FIG. 1 with the child being seated on a standard "adult" chair.
Figure 6C:
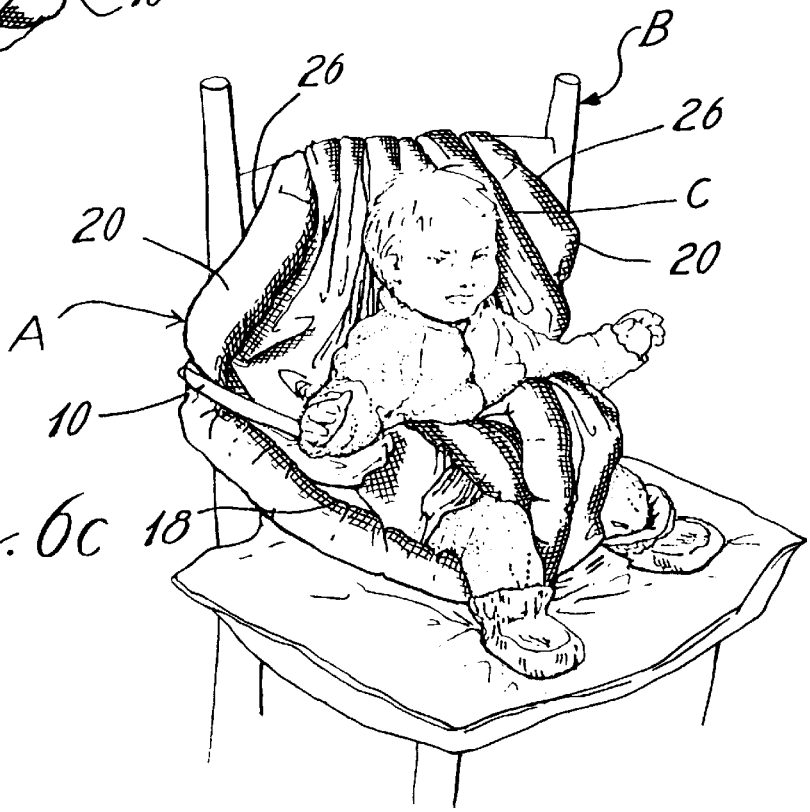
Figure 6B:
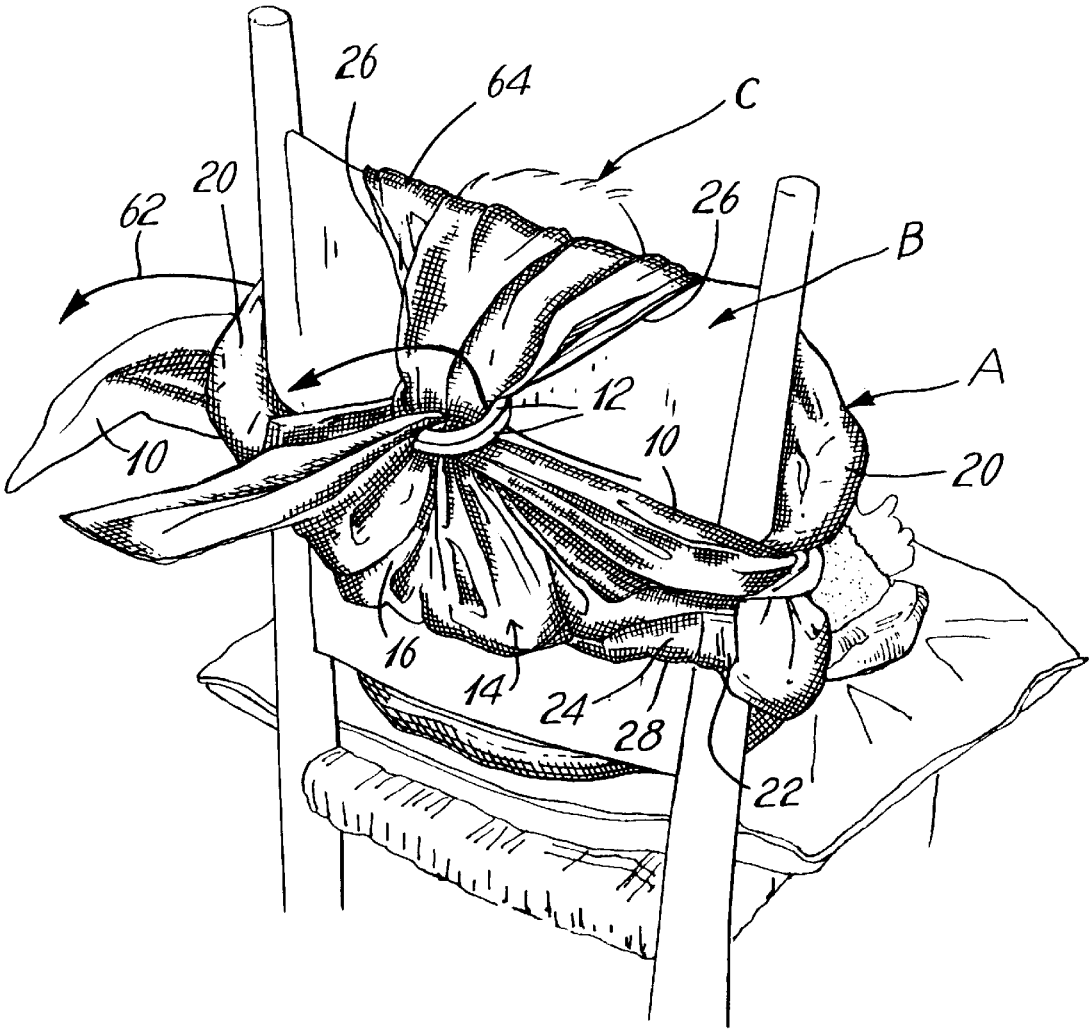

To use the apparatus A as a seat harness, the apparatus A must first be "unlooped" to its full length generally shown in FIG. 2*d*. Then, the harness hood or padded pocket 14 at the ringed end of the apparatus A is slid over the back B of a standard "adult chair", along the direction of arrow 60 in FIG. 6*a*. The length of the sling or apparatus A is draped over the chair seat and the apparatus A is twisted once, as shown in FIG. 6*a*. Next, the child C is seated on the fabric of the apparatus A supported by the seat of the chair, and the fabric is brought up, diaper-like, between the legs of the child. The ties or straps 10 are then pulled apart and the fabric slack is rolled up, sausage-style about the axis of the ties 10 (see FIG. 6*a*), until it is gathered snugly against the child's body. The straps 10 are then brought around the sides of the child C and just under the arms of the child, and then around the sides of the back B of the chair (or therethrough in some cases) along arrow 62, as seen in FIG. 6*b*. Also as seen in FIG. 6*b*, the straps 10 are secured behind the back B of the chair preferably by knotting the straps 10 through the rings 12 located behind the chair, along the direction indicated by arrow 64 in FIG. 6*b*. If the chair is too big for the straps 10 to reach around the back of the chair or even through the chair, the straps 10 can instead be tied together behind the child, that is between the fabric located opposite the child's back and the back B of the chair. FIG. 6*c* illustrates the child C secured to a standard chair using the present apparatus A in its seat harness position.

Figure 7:
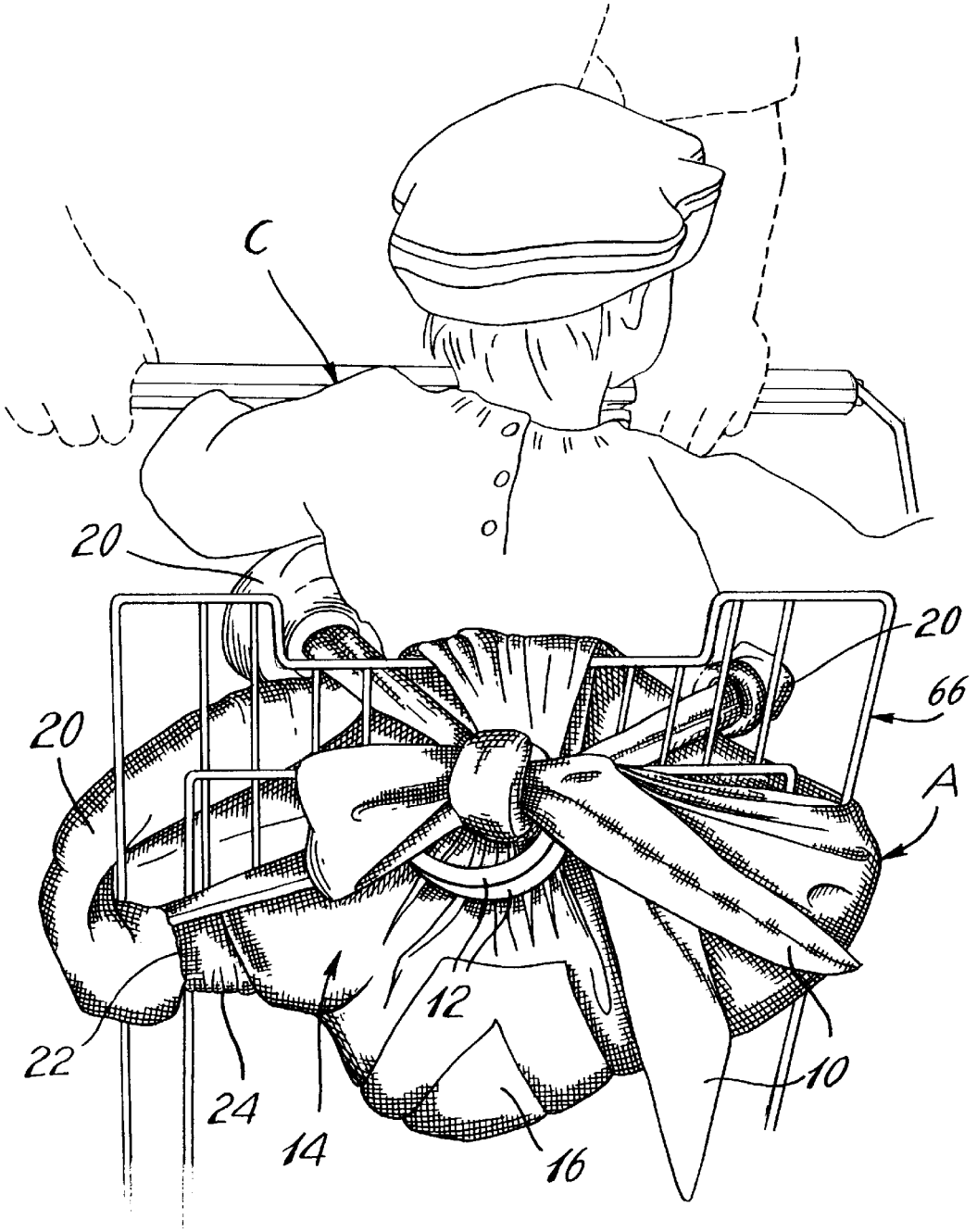
FIG. 7 is a schematical view similar to FIG. 6*c,* wherein the child is secured by the apparatus of the present invention in the seat harness position thereof, but with the child being seated in a standard shopping cart.

With reference to FIG. 7, if the apparatus A is used in a shopping cart 66, the same procedure as in FIGS. 6*a* to 6*c* applies asides from the straps 10 which must be threaded through the back of the cart seat and then be knotted through the rings 12 of the apparatus A.

With reference to FIG. 6*a*, to position the harness hood 14 over the back B of the seat, the harness hood 14 must be stretched out (that is pulled away from the body of the sling) so as to form a pocket that can be slid down over the back B of the chair with upper side corners of the back B extending through the side openings 26.

The wearer of the present apparatus A must always make sure that the ties or straps 10 are securely fastened, in most cases using the rings 12. For added security, a bow can be made with the straps 10 just below the rings 12.

It is noted that if the child falls asleep in the sling, when the apparatus A is in the child carrying position thereof, it is easy to transfer the child to his bed by leaning over the bed and resting the child and the pouch 18 on the bed, and then by slipping the looped apparatus A up and over the wearer's head. This maneuver can also be used to transfer a child from one caregiver to another.

When used in the child carrying position, the apparatus A can accommodate an extra piece of clothing and a spare diaper in the pocket defined under the cushioned harness hood 14.

The apparatus A can be packed away by rolling it from the end thereof defining the straps 10 and stuffing the fabric so rolled into the pocket formed by the harness hood 14.

Accordingly, the combination baby carrier and seat harness apparatus A of the present invention is comfortable for both child and parent, and allows for the child/baby to be easily positioned into the apparatus A and removed therefrom unaided. The present apparatus A reduces the physical strain of carrying a child and is suitable for infants and toddlers approximately up to 35 pounds. Very importantly, the present baby carrying sling also doubles as a seat harness.

I claim:

1. A sling-type child carrying apparatus comprising a pouch means adapted to receive a child therein, cooperating first and second attachment means provided substantially at first and second ends respectively of said apparatus in order that said apparatus defines a loop including a shoulder strap section when said first and second ends are attached one to another by way of said first and second attachment means, said pouch means being located intermediate said first and second ends; said apparatus being further adapted for use as a seat harness for a chair having seat and back parts, wherein said apparatus is laid partly on the seat part of the chair, the child being seated substantially on a first portion of said pouch means with said apparatus being secured to the back part of the chair substantially at said first end thereof, a second portion of said pouch means intermediate said first portion and said second end being at least partly rolled up and being positioned substantially in front of the child's trunk with a third portion of said pouch means intermediate said first and second portions extending between the child's legs and with said second end extending at least along one side of the child and being secured to at least one of the chair and said first end, wherein said pouch means is sufficiently rolled up at said second portion so that said apparatus snugly and safely secures the child to the chair, wherein said apparatus is provided adjacent said first end with engagement means adapted to be installed on the back part of the chair in a seat harness position of said apparatus with said first attachment means being positioned behind the chair in said seat harness position, wherein said first and second attachment means comprise catch means and tie means provided respectively at said first and second ends and adapted to be detachably secured to one another to form said loop used in a child carrying position of said apparatus, said tie means forming said shoulder strap section in said child carrying position, wherein said engagement means comprise a pocket means provided between said first end and said pouch means said pocket means, being opened at an inner end thereof located adjacent to said pouch means in order that said means can be slidably engaged over the back part of the chair in said seat harness position, wherein said pocket means comprise a pair of side openings defined between said first end and an inner transversal end of said pocket means located adjacent said pouch means, said openings allowing upper corners of the back part of the chair to extend through said pocket means.

2. An apparatus as defined in claim 1, wherein said inner end of said pocket means comprises elastic means for allowing said pocket means to be slid over the back part of the chair and to then relatively tightly surround the back part of the chair.

3. An apparatus as defined in claim 1, wherein said pocket means comprise padding means for providing said apparatus with a pillow-like support for the child's head when the child is in said sleeping position with said apparatus being in said child carrying position.

4. An apparatus as defined in claim 1, wherein said tie means comprise a pair of spaced apart elongated straps, said catch means comprising a pair of rings attached at said first end, said straps being engageable in said rings for securing said first and second together and, when said apparatus is used as said seat harness, said pair of straps extending from said pouch means along respective sides of the child and therebehind being engaged to said rings.

5. An apparatus as defined in claim 4, wherein said apparatus asides from said rings is substantially all made of flexible fabric, said pocket means being formed by a transversal fold of said fabric at said first end inwardly towards and above said pouch means, with said fabric having been threaded through said rings at said first end, inner corners of a folded over portion of said fabric being attached adjacent said pouch means thereby forming said pocket means which is open-ended inwardly towards said pouch means and which defines said side openings.

6. A sling-type child carrying apparatus comprising a pouch means adapted to receive a child therein, cooperating first and second attachment means provided substantially at first and second ends respectively of said apparatus in order that said apparatus defines a loop including a shoulder strap section when said first and second ends are attached one to another by way of said first and second attachment means, said pouch means being located intermediate said first and second ends: said apparatus being further adapted for use as a seat harness for a chair having seat and back parts, wherein said apparatus is laid partly on the seat part of the chair, the child being seated substantially on a first portion of said pouch means with said apparatus being secured to the back part of the chair substantially at said first end thereof, a second portion of said pouch means intermediate said first portion and said second end being at least partly rolled up and being positioned substantially in front of the child's trunk with a third portion of said pouch means intermediate said first and second portions extending between the child's legs and with said second end extending at least along one side of the child and being secured to at least one of the chair and said first end, wherein said pouch means is sufficiently rolled up at said second portion so that said apparatus snugly and safely secures the child to the chair, wherein cushioned members are provided at longitudinal sides of said apparatus at least opposite said pouch means.

7. A seat harness for securing a child to a chair, the chair having seat and back parts, said seat harness comprising seat means adapted to be positioned on the seat part of the chair and adapted to receive thereon a child in a sitting position, first attachment means rearwards of said seat means and adapted to be detachably secured to the chair substantially behind the child, elongated second attachment means made of a substantially flexible material and extending forwardly of said seat means, a first section of said second attachment means adjacent said seat means extending between the child's legs, a second section of said second attachment means being rolled up and positioned substantially in front of the child's trunk with a third section of said second attachment means extending around at least along one side of the child and being secured to at least one of the chair and said first attachment means, wherein said second attachment means is sufficiently rolled up so that said seat harness snugly and safely secures the child to the chair.

8. A seat harness as defined in claim 7, wherein said first attachment means comprise pocket means adapted to engage the back part of the chair.

9. A seat harness as defined in claim 8, wherein said first attachment means comprise catch means provided behind the back part of the chair, and wherein at least said third section of said second attachment means comprise elongated tie means adapted to be brought around the child and rearwards of the back part of the chair whereat said tie means are engaged with said catch means for securing the seat harness and the child to the chair.

10. A seat harness as defined in claim 9, wherein said catch means comprise rings and said tie means comprise a pair of straps each to be brought around a respective side of the child and then secured to said rings.

11. A seat harness as defined in claim 8, wherein said pocket means comprise a pair of side openings adapted to allow upper corners of the back part of the chair to extend through said pocket means.

12. A seat harness as defined in claim 8, wherein said pocket means comprise elastic means for allowing, when stretched, said pocket means to be slid over the back part of the chair and to then, when released, biasedly cause said pocket means to relatively tightly embrace the back part of the chair.

13. A method for securing a child to a chair, the chair having seat and back parts, said method comprising the steps of:

a) providing a seat harness comprising seat means, and first attachment means and elongated substantially flexible second attachment means provided on one end and another of said seat means;

b) positioning said seat means on the seat part of the chair;

c) detachably securing said first attachment means to the chair and positioning the child in a sitting position on said seat means;

d) bringing up a first section of said second attachment means between the child's legs and then rolling up at least partly said first section towards the child until said first section is positioned substantially in front of the child's trunk; and e) bringing a second section of said second attachment means at least along one side of the child and securing said second section at least to one of the chair and said first attachment means, wherein said first section is located between said seat means and said second section and said second attachment means is sufficiently rolled up so that said seat harness snugly and safely secures the child to the chair.

14. A method as defined in claim 13, wherein said first attachment means comprise pocket means adapted in step c) to engage the back part of the chair, and wherein in step e) said second attachment means are brought around both sides of the child and secured therebehind.

15. A method as defined in claim 13, wherein said first attachment means comprise catch means located in step c) behind the back part of the chair, and wherein said second section of said second attachment means comprise elongated tie means adapted in step e) to be brought around the child and rearwards of the back part of the chair whereat said tie means are engaged with said catch means for securing the seat harness and the child to the chair.

16. A method as defined in claim 15, wherein said catch means comprise rings and wherein said tie means comprise a pair of straps each, in step e), being brought around a respective side of the child and then secured to said rings.

* * * * *